United States Patent [19]

Monden et al.

[11] 4,186,567

[45] Feb. 5, 1980

[54] ORNAMENT UTILIZING RARE EARTH-COBALT MAGNET

[75] Inventors: Souhei Monden, Inuyama; Sadaharu Takimoto, Kumagaya, both of Japan

[73] Assignee: Hitachi Metals, Ltd., Tokyo, Japan

[21] Appl. No.: 881,239

[22] Filed: Feb. 27, 1978

[30] Foreign Application Priority Data

| | | | |
|---|---|---|---|
| Apr. 18, 1977 | [JP] | Japan | 52/47736[U] |
| Apr. 18, 1977 | [JP] | Japan | 52/47737[U] |
| Apr. 18, 1977 | [JP] | Japan | 52/47738[U] |
| Jun. 22, 1977 | [JP] | Japan | 52/81007[U] |

[51] Int. Cl.[2] ..... A44C 7/00

[52] U.S. Cl. ..... 63/14 R

[58] Field of Search ..... 63/14 R, 29 M; 24/201 B, 73 MS, 49 M

[56] References Cited

U.S. PATENT DOCUMENTS

| | | | |
|---|---|---|---|
| 2,803,953 | 8/1957 | Zubalik | 63/14 R |
| 3,034,320 | 5/1962 | Feibelman | 63/14 R |
| 3,071,939 | 1/1963 | Feibelman | 63/14 R |

*Primary Examiner*—F. Barry Shay

*Attorney, Agent, or Firm*—Finnegan, Henderson, Farabow & Garrett

[57] ABSTRACT

An ornament adapted to be fixed by permanent magnets has an ornament piece to which is fixed a gem or the like, and an attracting piece confronting the ornament piece. The ornament piece and/or the attracting piece is provided with a rare earth-cobalt magnet embedded therein, so that these pieces may be held by each other by means of the magnetic attracting force which acts across a non-magnetic body such as an earlobe. The level of the magnetic attracting force is so selected as to fall, when the pieces confront each other across a distance approximating the thickness of an ear lobe, within a range of between 30 grams and 100 grams per square centimeter of attaching area and, at the same time, to be larger than 30 grams per gram of weight of the ornament, so that the user may put the ornament which may be an earring, without pain nor the fear of unintentional dropping.

22 Claims, 30 Drawing Figures

FIG. 9B
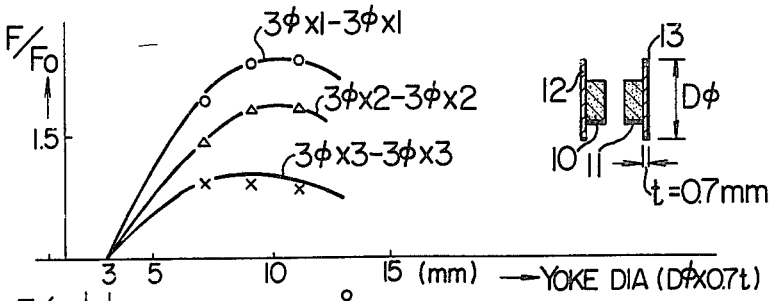
FIG. 9A
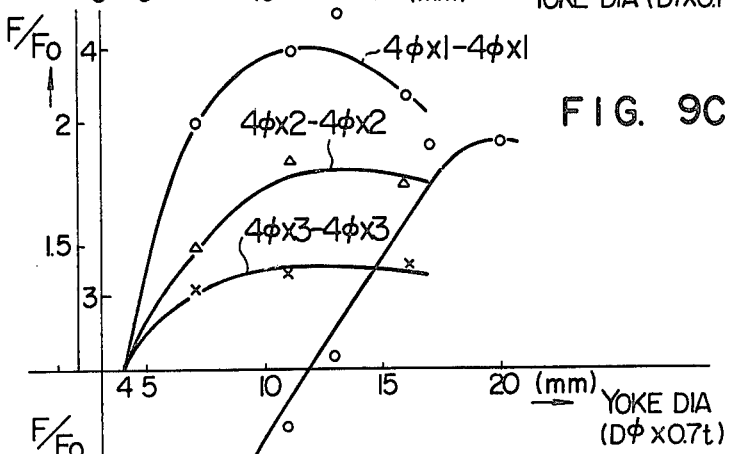
FIG. 9C
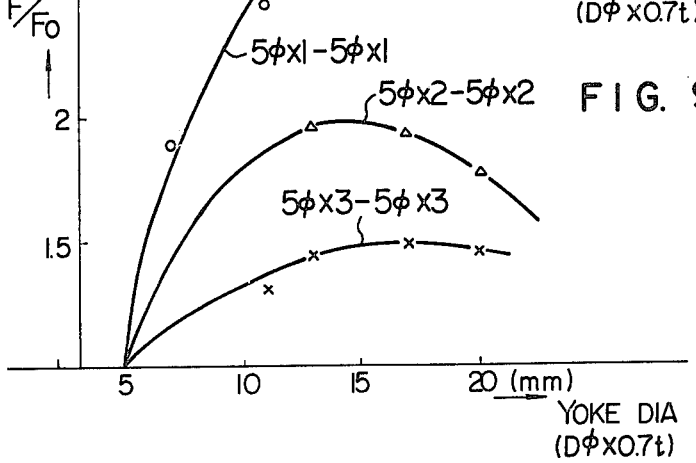
FIG. 9D

ORNAMENT UTILIZING RARE EARTH-COBALT MAGNET

BACKGROUND OF THE INVENTION

1. Field of the Invention

The present invention relates to an ornament adapted to be fixed by means of a permanent magnet and, more particularly, to an ornament in which a rare earth-cobalt magnet or magnets are embedded in an ornament piece and/or in a cooperative attracting piece, wherein the magnetic attracting force is so selected to fall within a range of between 30 grams and 100 grams per square centimeter of the attaching area of the ornament body and, at the same, to be larger than 30 grams per gram of weight of the same.

2. Description of the Prior Art

Earrings are known as such a kind of ornament as having gems or the like attached to earlobes. Hitherto, three types of earrings have been used. More specifically, a first type of earrings has as shown in FIG. 1A, an ornament piece 1, an U-shaped adapter 2 and a cramp 3. This type of earring is attached to the earlobe by elastically cramping the latter by a cooperation of the U-shaped adapter 2 and the cramp 3.

FIG. 1B shows a second type of the conventional earrings having an ornament piece 1, U-shaped adapter 2 and a screw 4. The screw 4 and the U-shaped adapter 2 cooperate such that they cramp the earlobe when the screw 4 is driven deeper into the bore of the adapter 2 toward the earlobe.

A third type of conventional earrings has, as shown in FIG. 1C, a pin 5 to which an ornament piece 1 is fixed and a pin cramp 6. For attaching this type of earrings, the earlobe is previously pierced to form a small bore through which the pin 5 is inserted and retained by the pin cramp 6 at the back side of the earlobe.

Concerning the earrings as shown in FIGS. 1A and 1B, it is preferred to make the U-shaped adapters 2 invisible. Therefore, the constructions of the earring as shown in FIG. 1A and 1B are suitable for use in holding relatively large ornament pieces, rather than small-sized ornaments. The earring construction as shown in FIG. 1C requires the piercing of the earlobes, which has to be made only by skilled and authorized hands, although it may be suitably used for holding small-sized ornament pieces.

In order to overcome these disadvantages of the conventional three types of earrings, an idea of fixing the earrings to earlobes by means of magnets has been proposed for some time.

This way of fixing of the earrings is to make use of permanent magnets in both the ornament piece put on the front side of the lobe and the iron piece put on the back side of the lobe, so that they may be held on the lobe by the magnetic force which acts across the lobe.

However, unfortunately, conventional magnets such as alnico or ferrite magnet cannot provide a magnetic force across the earlobe, which is usually 2.5 to 3.0 mm thick, large enough to hold the pieces on the lobe.

More specifically, although the alnico magnet has a relatively large maximum value of the energy product of $10\times10^6$ gauss oersted, this advantage cannot be efficiently made use of when the alnico magnet is used as the fixing means for earrings, because the alnico magnet has a vertically elongated form of its hysteresis loop. Namely, assuming here two disk-shaped magnets of 5 mm diameter and 1 mm thickness magnetized in the thicknesswise direction (This magnet will be referred to as $5\phi\times1$ magnet, hereinafter), the magnetic force acting between these magnets spaced by 2.5 mm is as small as about 0.8 grams.

The ferrite magnet is more advantageous in designing the $5\phi\times1$ magnets, although it has a relatively small maximum value of an energy product of $4\times10^6$ gauss oersted. Thus, in case of the ferrite magnet, the magnetic force acting between the two $5\phi\times1$ magnets is about 3 grams.

However, the magnetic attracting force of the ferrite magnet of 3 grams is too small to securely hold the ornament on the earlobe against a usual movement of the user.

Recently, rare earth-cobalt magnets have been successfully developed, which conveniently have a large value of an energy product of $26\times10^6$ gauss oersted, and a hysteresis characteristic similar to that of the ferrite magnet. It has been confirmed that the magnetic attracting force acting between two $5\phi\times1$ rare earth-cobalt magnets is as large as 14 grams, when these magnets are spaced by 2.5 mm from each other. This naturally triggered the desire to put the earrings fixed by permanent magnets into practical use.

SUMMARY OF THE INVENTION

It is therefore an object of the invention to provide an ornament, especially an earring, which can be fixed by means of rare earth-cobalt permanent magnets.

It is another object of the invention to provide an ornament, particularly an earring, which can be used for a long time without imparting a feel of pain, due to an attracting force which ranges between 30 grams and 100 grams per square centimeter of attaching area of the ornament.

It is still another object of the invention to provide an ornament, particularly an earring, which can hardly be dropped off even when a user jumps and hops, by selecting the magnetic attracting force larger than 30 grams per gram weight of the ornament body.

It is a further object of the invention to provide an ornament, particularly an earring, adapted to be fixed by permanent magnets having novel construction such as a combination of magnets of different diameters or so-called multi-magnetized construction.

BRIEF DESCRIPTION OF THE DRAWINGS

FIG. 9A shows an arrangement for measuring the attracting force upon provision of yokes to both magnetic disks, FIGS. 9B, 9C and 9D are graphical representation of the change in magnetic attracting force in the arrangement shown in FIG. 9A, FIGS. 10A, 10B and 10C show constructions of embodiments of the present invention.

DETAILED DESCRIPTION OF THE PREFERRED EMBODIMENTS

In the following description of the preferred embodiments, the discussion is focussed specifically on earrings. However, this is not exclusive and the invention can be embodied in the form of ornaments other than the earrings.

As stated before, the idea of fixing the earrings by permanent magnets has been known for a long time. However, thanks to the recent development of rare earth-cobalt magnets, it is now possible to improve greatly earrings with permanent magnets.

In developing the earrings adapted to be fixed by permanent magnets, an investigation was made to seek the mean thickness of the earlobe. As a result, it has been confirmed that the mean thickness of the earlobe is 3 mm.

The magnetic attracting force F (grams) acting between two magnetic disks confronting each other across an air gap Lg is experimentally given by the following equation.

$$F=KB_1\cdot B_2\sqrt{A_1\cdot A_2}\times[Lg(D_1+D_2)/2\text{-}D_1\cdot D_2]^{-1.8}\times 10^{-6}\text{(grams)}$$

where,

K: a coefficient $B_1$, $B_2$: magnetic flux densities of magnetic disks (gauss)

$A_1$, $A_2$: areas of confronting surfaces of magnetic disks ($cm^2$)

Lg: distance of air gap (cm)

$D_1$, $D_2$: diameters of magnetic disks

Figure 1A:
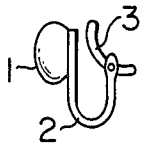
FIG. 1A PRIOR ART
FIGS. 1A, 1B and 1C are illustrations explanatory of conventional types of earrings.
Figure 1B:
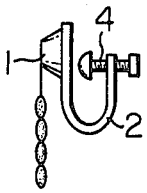
FIG. 1B PRIOR ART
Figure 1C:
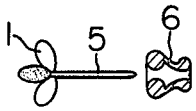
FIG. 1C PRIOR ART
Figure 2A:
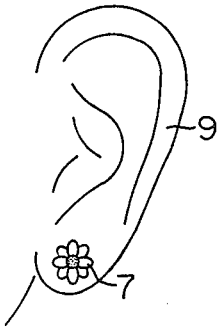
FIGS. 2A and 2B are illustrations explanatory of the manner of fixing of an earring embodying the present invention.
Figure 2B:
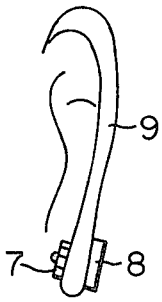

Referring now to FIGS. 2A and 2B showing the manner of fixing of an earring embodying the invention, the earring consists of an ornament piece 7 to which a gem or the like is attached, and an attracting piece 8 adapted to magnetically attract and hold the ornament piece 7 from the back side of the earlobe 9. The ornament piece 7 and/or the attracting piece 8 is provided with the aforementioned rare earth-cobalt magnet embedded therein.

The rare earth-cobalt magnet is formed to have, for example, a disk-like shape of 5 mm diameter and 1 mm thickness, and is magnetized such that, for instance, one surface exhibits a polarity of N, while the other exhibits a polarity of S, i.e., magnetized in the thicknesswise direction. This disk-shaped magnet is referred to as "magnetic disk", throughout this specification. It is preferable that in case of necessity two facing magnets are connected with string such as silkworm gut and the like until users grow familiar with wear or use of earrings.

The present inventors have made a test in which the earrings having the magnetic disk embedded therein were actually used by a number of users, from which derived are following conclusions.

(1) Due to an excessively large attracting force exerted by the magnetic disk, one of the users complained a pain in the earlobe after a 30 minute use, and had to massage the earlobe after removing the earring. Some of the users, although not complaining of pain, felt an unpleasant reaction which made them wish not to put on the earring any more. The threshold of the attracting force for causing this pain and unpleasant feel of use was confirmed to be 80 to 100 grams per square centimeter.

(2) When the attracting force between the ornament piece 7 and the attracting piece 8 across the earlobe came down lower than a certain level, some of the earrings dropped by a simple swing of heads of users. To clarify this level of force, a test was conducted in which the users jumped down from a height of 1 meter. The threshold of the attracting force for ensuring no dropping off of the earrings upon the jumping down was observed to be 5 to 8 grams, which correspond to 30 grams or larger per gram weight of the earring.

(3) Such a phenomenon convenient for the inventors was found during the test of earrings manufacture to clear the above thresholds, that the portion of the earlobe is compressed and recessed to a thickness of about 2.5 mm, so that the earring is held on the earlobe as if it is embedded in the earlobe, which conveniently ensures that the earring is never dropped off against the user's will, i.e., unintentionally.

Figure 3:
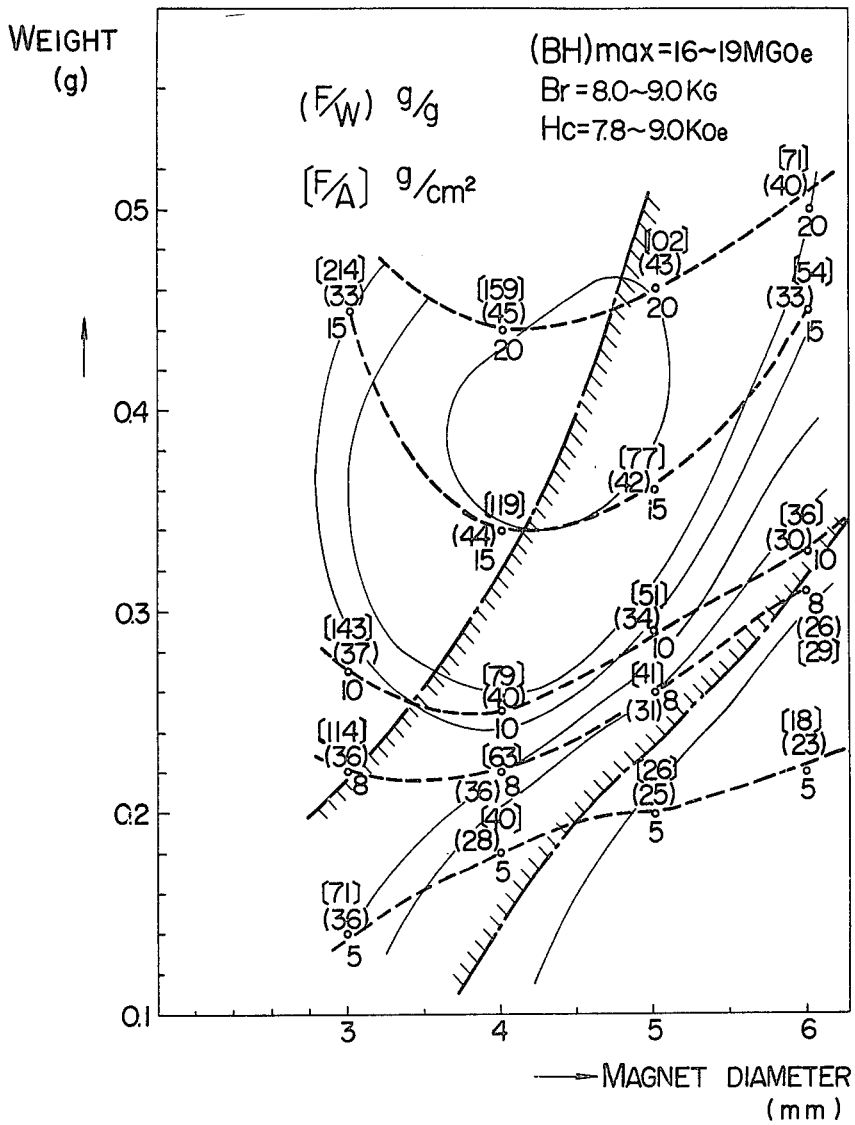
FIG. 3 shows an example of the range of attracting force exerted in an earring in accordance with the invention.

FIG. 3 shows the range of attracting force of an earring which is manufactured to meet the above respects, in which the axes of abscissa and ordinate represent, respectively, the diameter (mm) of the magnetic disk and the weight (grams) of the earring, on an assumption that the weight of the magnetic disk is equal to that of the earring. In this example, such a rare earth-cobalt magnet is used as having a residual induction (Br) of 8.0 to 9.0 kilogauss, a coersive force (Hc) of 7.8 to 9.0 kilooersted, and a maximum energy product ((BH) max) of 16 to $19\times 10^6$ gauss oersted. Weights of magnetic disk samples of different diameters of 3 mm, 4 mm, 5 mm and 6 mm, selected for causing levels of attracting force of 5, 8, 10, 15 and 20 grams are plotted and connected by broken line curves. The attacting force (grams) per gram weight of earrings, i.e., the value F/W, is pencilled in parenthesis ( ) for each plot. The attracting force (grams) per square centimeter of contact area of the earring, i.e., the value of F/A, is shown in bracket [ ]for each plot. Points of equal value of F/W are connected by full-line curves.

In FIG. 3, the range defined by shadow lines is selected to be the range which is critical for ensuring no unintentional dropping off of the earring and wearing without being accompanied by pain. More specifically, the range is selected to be of the F/A value between 30 and 100 grams per square centimeter and of the F/W value of larger than 30 grams per gram weight of the earring. More strictly, a further requisite is selected that the magnetic attracting force is greater than 5 grams.

Figure 4:
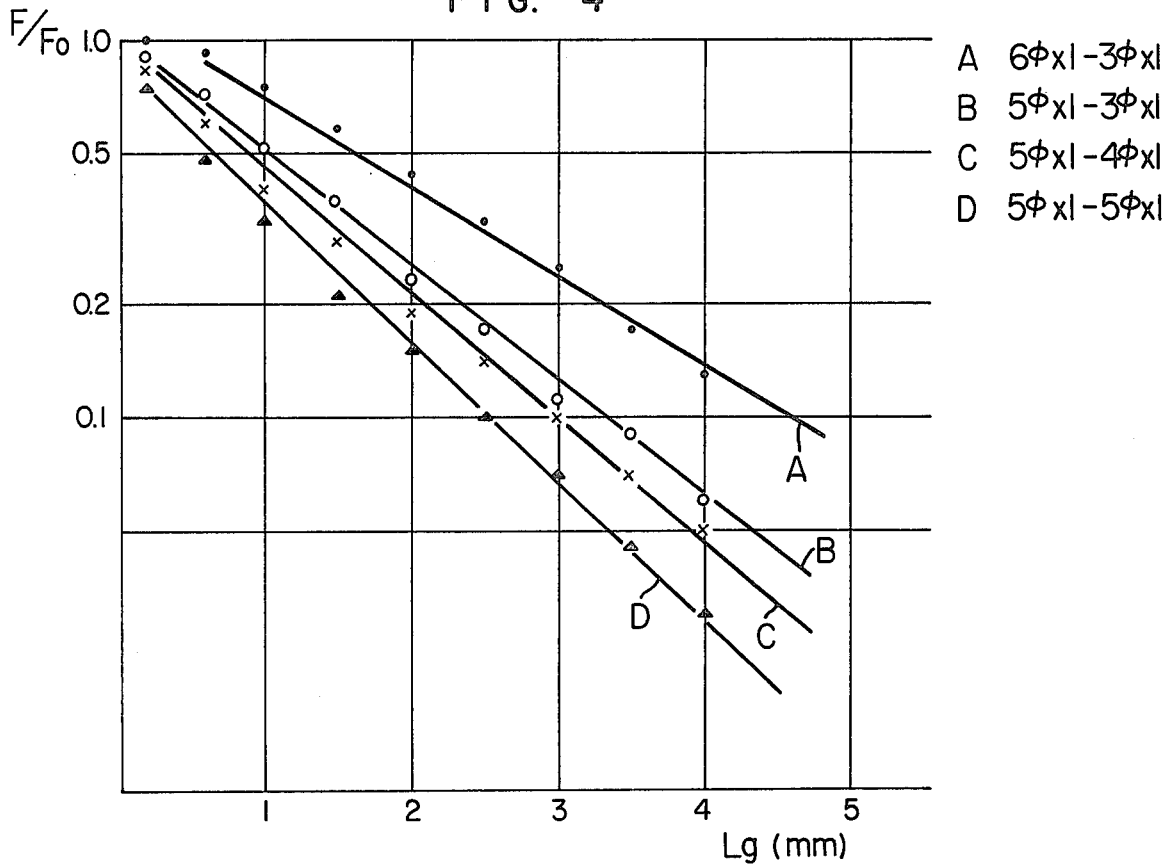
FIG. 4 is a graphical representation of a relationship between the air gap and the attracting force in combined use of magnetic disks.

The inventors have investigated the change of the magnetic attracting force due to the change of the air gap distance, for various combinations of the magnetic disc embedded in the attracting piece and that embedded in the ornament piece. FIG. 4 shows the magnetic attracting forces for varying air gap distance Lg (mm), with the force Fo corresponding to the air gap distance Lg of 0 mm being normalized. In FIG. 4, plots A are made for a combination of a magnetic disk of 6 mm diameter by 1 mm thickness (referred to as $6\phi\times1$ magnetic disk) with a magnetic disk of 3 mm diameter by 1 mm thickness ($3\phi\times1$ magnetic disk).

Similarly, plots B, C and D are made for a combination of $5\phi\times1$ magnetic disk with $3\phi\times1$ magnetic disk, a combination of $5\phi\times1$ magnetic disk with $4\phi\times1$ magnetic disk and a combination of two $5\phi\times1$ disks with each other.

It will be seen from FIG. 4 that the combination of magnetic disks of different diameters is preferred.

A further investigation was made, as is the case of the investigation for obtaining the graph of FIG. 4, as to the change of the magnetic attracting force due to the deviation or misalignment of the magnetic disks, for various combinations of magnetic disks.

Figure 5:
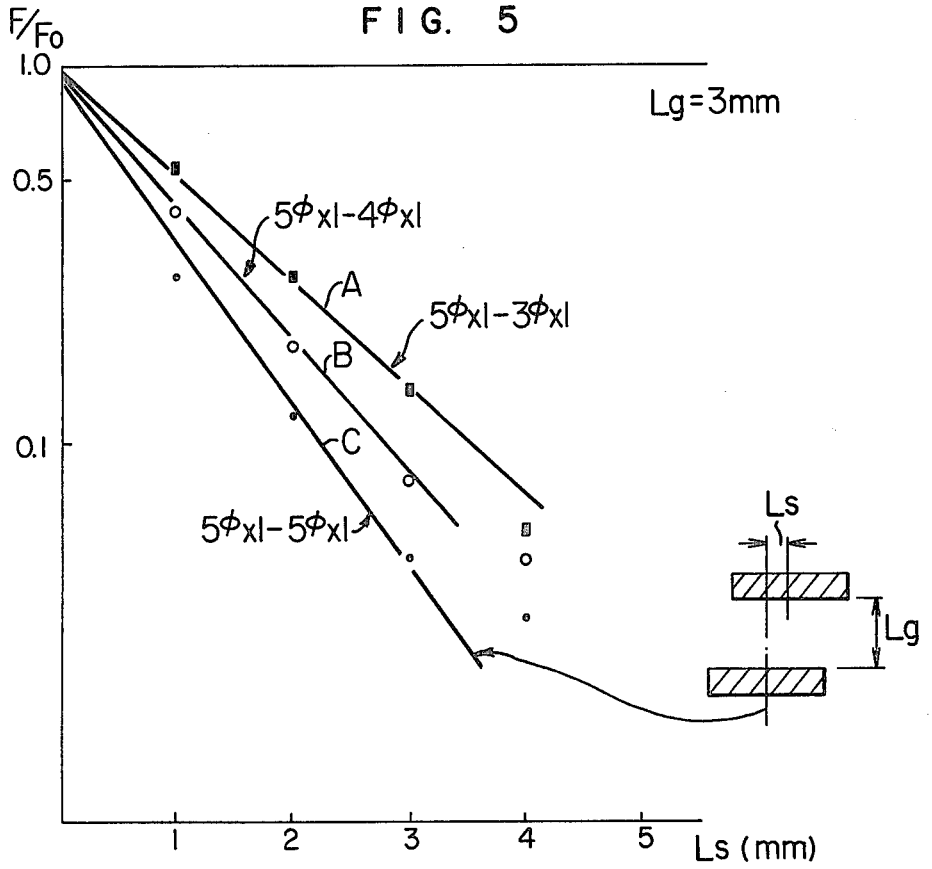
FIG. 5 is a graphical representation of a relationship between lateral deviation of magnetic disks and the attracting force in combined use of magnetic disks.

FIG. 5 shows the magnetic forces for varying deviation Ls (mm) of disk centers on the basis of the magnetic force Fo obtained when Ls is zero, with the air gap distance Lg fixed at 3 mm. The deviation of disk centers is shown on the axis of abscissa. In FIG. 5, plots A, B and C are made for the combination of $5\phi\times1$ disk with $3\phi\times1$ disk, the combination of $5\phi\times1$ disk with $4\phi\times1$ disk and the combination of $5\phi\times1$ disks with each other, respectively. From FIG. 5, it is derived that the use of combination of magnetic disks of different diameters is preferred also for diminishing the deviation of disk centers. However, needless to say, the plots A are also effective for use in earrings, because the force Fo on the basis of which the plots C are made is large as compared with that Fo for the plots A enough to prevent unintentional dropping off of the earrings or other inconveniences.

Figure 6:
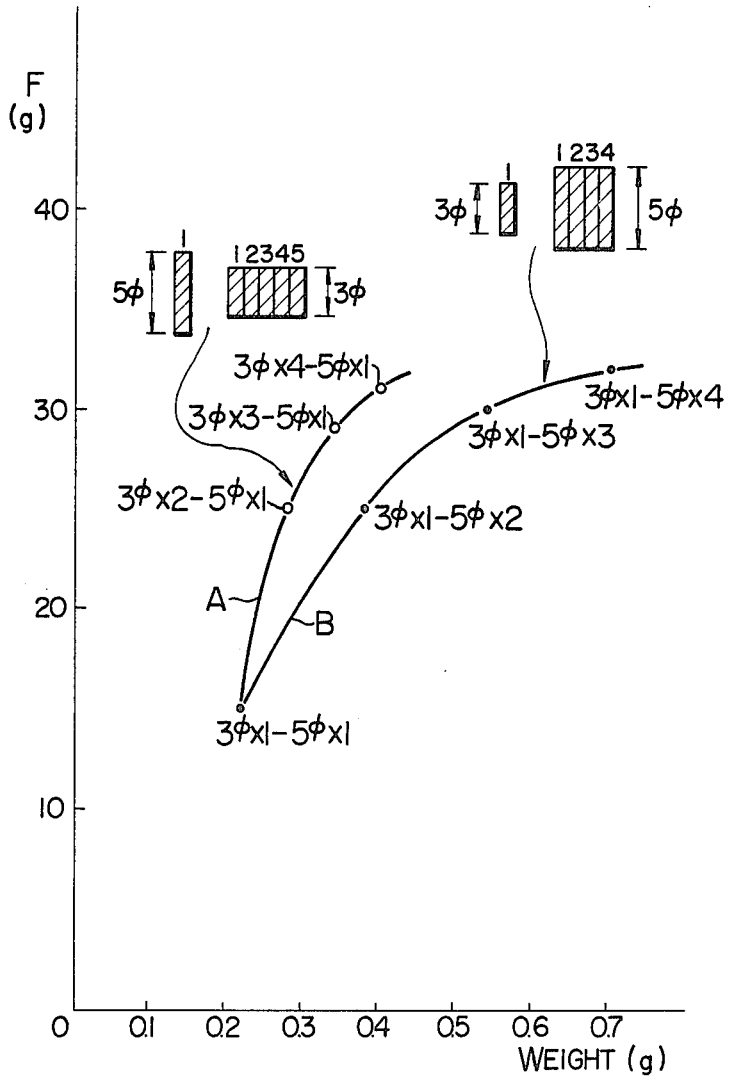
FIG. 6 is a graphical representation of a relationship between the thickness of the magnetic disk and the attracting force.

Then, the inventors have made a further investigation to confirm which one of the disks of different diameters is more influential on the change of the magnetic attracting force when their thicknesses are varied, the result of which is shown in FIG. 6. Weights (grams) and attracting forces (grams) are shown by the axes of abscissa and ordinate, respectively. Plots A and B are made for the magnetic attracting forces in relation with the increments of the thicknesses of the smaller and larger magnetic disks, respectively. It will be seen from FIG. 6 that the increment of the thickness of the smaller magnetic disk is more influential and, therefore, more effective than the increment of thickness of the larger magnetic disk, when the attracting force per gram weight is evaluated. The magnetic attracting force per gram weight of the ornament is closely related to the possibility of the unintentional dropping off of the earring. For this reason, for securing the earring, it is preferred to increase the thickness of the smaller magnetic disc. The magnetic attracting force can be increased almost doubly, by increasing the thickness of the smaller magnetic disk.

Figure 7:
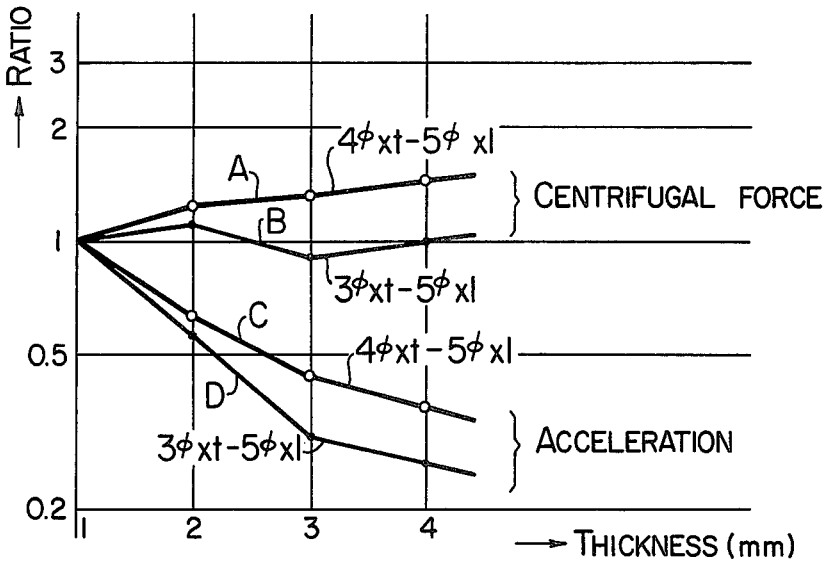
FIG. 7 is a graphical representation of a threshold of centrifugal force at which the magnetic disk is scattered, in relation with various disk thicknesses, and the acceleration to which the magnetic disk is subjected.

However, on the other hand, the increase of the magnetic disk thickness, i.e., the axial height of the magnetic disk, inconveniently increases the possibility of incurring an unintentional dropping off of the earring. From this point of view, the inventors investigated how the possibility or the chance of unintentional dropping of the earring is increased due to the increment of the thickness of the magnetic disk. More specifically, magnetic disks of various thicknesses were mounted on a rotary arm, to seek for the threshold for causing the scattering of the magnetic disks. Namely, the magnetic disk of larger diameter was fixed to the rotary arm, and the magnetic disk of smaller diameter was attracted by and secured to the larger diameter disk with an air gap of 2.5 mm, i.e., with a non-magnetic material interposed between the two disks. The speed of rotation of the rotary arm was increased gradually, to seek for the threshold of the centrifugal force which makes the smaller diameter magnetic disk separate from the non-magnetic substance and scatter away. The obtained thresholds were then calculated into the degree of acceleration. The result of this test is shown in FIG. 7. The ordinate shows the ratio of the measured threshold centrifugal force for each thickness of a magnetic disk to that of 1 mm thick magnet.

The attracting force acting between two magnetic disks is gradually increased as the thickness of the smaller diameter magnetic disk is increased as 1 mm, 2 mm, 3 mm and then 4 mm. Therefore, the threshold of the centrifugal force which causes the separation of the smaller diameter disk overcoming the magnetic attracting force is maintained almost constant, irrespective of the increment of the thickness of the magnetic disk, as will be seen from curves A and B in FIG. 7.

From the plots A, B in FIG. 6 and the plots A, B in FIG. 7, it is derived that it is more effective to increase the thickness of the smaller diameter magnetic disk, as compared with the increment of the thickness of the larger diameter magnetic disk, when magnetic disks of different diameters are used in combination, when the attracting force per unit weight is taken into consideration.

The increase of chance of unintentional dropping off of the earring, attributable to the increase of the thickness, is negligibly small.

Plots C and D in FIG. 7 show the accelerations applied to the magnetic discs, calculated from the thresholds of the centrifugal force for causing the separation of the magnetic disks. From these plots, it will be seen that the threshold acceleration is reduced down to the level of $\frac{1}{3}$ as the thickness is increased to 4 mm or so. In other words, the earring may drop when an acceleration of the level of $\frac{1}{3}$ is applied.

However, the level of acceleration which causes a dropping of the magnetic disk of 4 mm thick is as high as 10 G (gravitational acceleration) to 15 G, which is never experienced in the usual condition of use. Thus, there is almost no possibility of dropping of the earring.

When a relatively large earring is to be fixed, the size of the magnetic disk has inevitably to be large. From this point of view, inventors have been made an investigation for obtaining the optimum pattern of magnetization.

Figure 8:
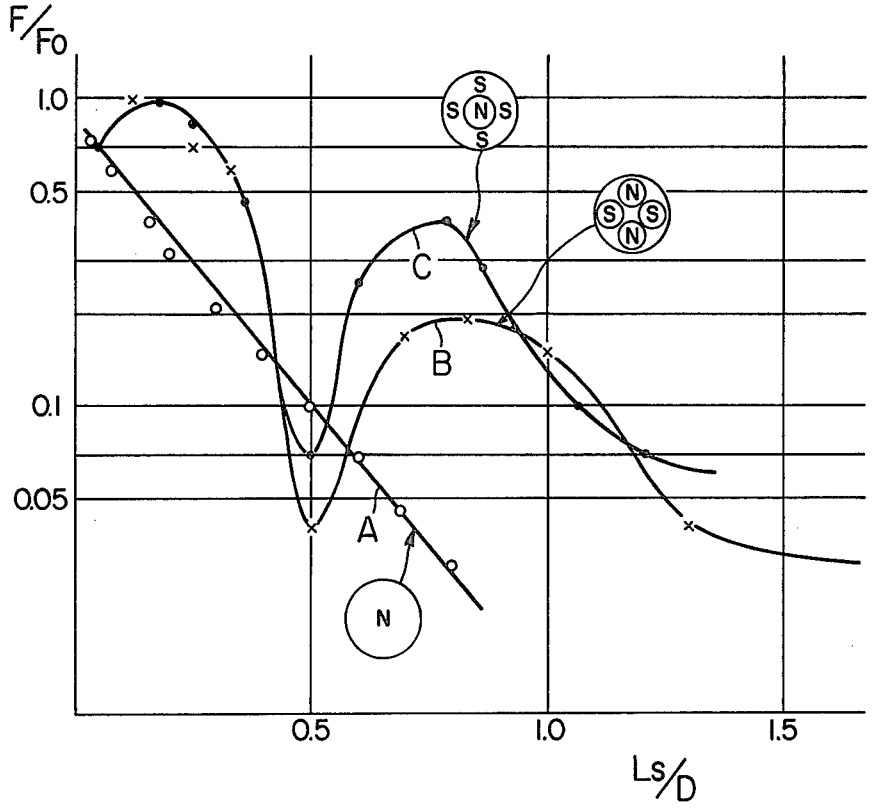
FIG. 8 is a graphical representation of the change in the attracting force due to the deviation of the center, when the magnetizing mode for the magnetic disk is changed.

FIG. 8 shows how the magnetic attracting force is changed by the deviation of the centers of magnetic disks, for various patterns of magnetization of the magnetic disks. Axis of abscissa represents the deviation Ls of the centers of two confronting magnetic disks from each other when they are spaced by an air gap distance of Lg from each other, normalized by the diameter D of the magnetic disks, while axis of ordinate represents the attracting force F acting between the magnetic discs, normalized by the attacting force Fo obtained when the deviation Ls is zero.

In FIG. 8, the plots A represent the characteristic of the magnetic disk combination corresponding to that of FIG. 5 in which only one magnetic pole is formed on one disk surface, while curve B is plotted for magnetic disk combination in which the surface of the disk is divided to have four magnetic poles. Also, curve C is plotted for the magnetic disk comhination in which the disk surface is magnetized to have different concentric poles.

As will be clearly seen from FIG. 8, the magnetic attracting forces of curves B and C have two peak values. More specifically, the value of F/Fo is reduced to below 0.1 around the region of Ls/D being 0.5, and again increases to the level of 0.2 to 0.4 as the value of Ls/D is increased to 0.75. The level of F/Fo is still as high as 0.1 or so, even when the value of Ls/D has been increased to 1.0. This is effective to prevent the accidental dropping of the earring, even when the disk centers happen to be displaced by an external impact.

The inventors then turned to investigate how the magnetic attracting force is changed by a provision of a yoke of good magnetic permeability on the magnetic disk.

Namely, a test was conducted to confirm the result on the magnetic disks 10, 11, of the provision of the yokes 12, 13 as shown in FIG. 9A, for varying diameters of the yokes. The curves in FIG. 9B have been plotted for the magnetic attracting forces between 3$\phi$ magnets, when they are provided with yokes of 7 mm, 9 mm and 11 mm diameters, respectively.

The curves in FIG. 9C have been plotted for 4$\phi$ magnetic disks having yokes of 7 mm, 11 mm and 16 mm diameters.

Similarly, the curves in FIG. 9D have been plotted for 5$\phi$ magnetic disks having yokes of 11 mm, 12 mm, 16 mm and 20 mm diameters.

From these Figures, it will be seen that the effect of the provision of the yokes is more remarkable when the thickness of the magnetic disk is small, than when the thickness is large. The amount of increase of the magnetic attracting force due to the provision of the yokes depends on the diameters and the thicknesses of the magnetic disks. However, in each case, the increase of the attracting force is greatest when the diameter of the yokes 12, 13 is about three times as large as that of the magnetic disks 10, 11. This means that the magnetic attracting force can be increased without the increase of the thickness of the magnetic disks, and suggests that a large-size earring can be designed by suitably decorating the surface of the yokes themselves.

FIGS. 10 to 13 show various forms of earrings which have been worked out as a result of the foregoing tests.

Figure 10A:
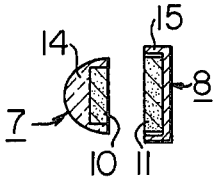

More specifically, the earrings as shown in FIG. 10A has a small diameter magnetic disk 10 associated with the ornament piece 7, and is embedded in a base 14 which plays also the role of a decoration. The earring further has a large diameter magnetic disk 11 associated with the attracting piece 8 and embedded in the base 15.

Figure 10B:
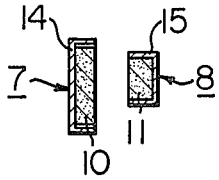

In the earring as shown in FIG. 10B, a larger diameter magnetic disk 10 is used in combination with the ornament piece 7, while a smaller diameter magnetic disk 11 is combined with the attracting piece 8. Other portions are identical to those of FIG. 10A.

Figure 10C:
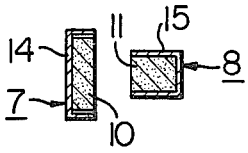

Referring now to FIG. 10C, the smaller diameter magnetic disk is combined, for example, with the attaching piece 8 and is made to have an increased thickness. Other portions are same as those of the earring of FIG. 10B.

The forms of earrings as shown in FIG. 10A and FIG. 10B are derived from the experiments shown in relation with FIGS. 4, 5 and 6, while the form of the earring of FIG. 10C has been worked out from the experiments shown in relation with FIGS. 4 through 7.

Needless to say, the earring as shown in FIG. 10C can be modified such that the smaller diameter magnetic disc is combined with the ornament piece 7 and has an increased thickness.

Figure 11A:
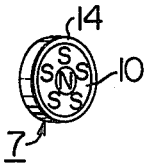
FIGS. 11A and 11B show a construction of another embodiment produced by a different mode of magnetization.
Figure 11B:
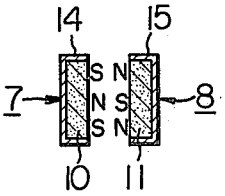

FIG. 11A is a perspective view of the ornament piece 7 magnetized in the same manner as that of the curve C of FIG. 8, while FIG. 11B shows a cross-section of the ornament piece 7 and the attracting piece 8 magnetized in the same manner.

Figure 12:
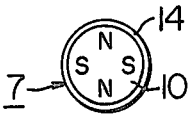
FIG. 12 shows a construction of still another embodiment of the invention produced by different mode of magnetization.

FIG. 12 shows a bottom plan view of an ornament piece magnetized in the same pattern as that of the curve B of FIG. 8.

Figure 13A:
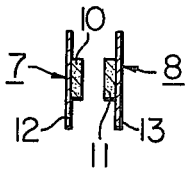
FIGS. 13A, 13B, 13C and 13D are illustrations of different embodiments of the invention having respective yokes, and FIGS. 14 through 18 inclusive show different embodiments of the invention in which bases for holding the magnetic disks are made of non-magnetic material.

In the earring as shown in FIG. 13A, the magnetic disk 10 is attached to a yoke 12 which is provided at the ornament side and part of the ornament piece, while the magnetic disk 11 is attached to a yoke 13 at the attracting piece side.

Figure 13B:
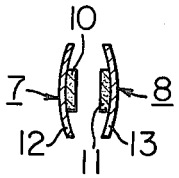

The earring as shown in FIG. 13B is the same as that of FIG. 13A, except that the yokes 12, 13 are slightly curved.

Figure 13C:
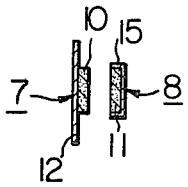
Figure 13D:
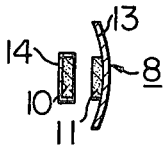

FIG. 13C shows an earring in which the yoke 12 is provided only at the ornament piece side, while FIG. 13D shows an earring in which the yoke 13 is provided only at the attaching piece side.

The forms of earrings as shown in FIGS. 13A to 13D have been worked out from the conclusion of discussion previously made in relation with FIG. 9. The earrings as shown in FIGS. 13A to 13D may optionally be modified to incorporate magnetic disks of different diameters in view of the teaching of FIG. 10, or to increase the thickness of the smaller diameter magnetic piece. Similarly, these earrings have any desired pattern of multi-magnetization as shown in FIGS. 11 and 12.

It will be seen that these modifications are fairly involved in the scope of the present invention.

As an analogy from each of the earrings as shown in FIGS. 13A to 13D, it is possible to make the bases 14 and 15 play the role of the yokes. However, this form is not always preferred, because the magnetic circuit is undesirably shunted by these yokes, so as to reduce the magnetic attracting force, when the two magnetic disks are made to confront each other across an air gap which is as small as 2.5 mm or so, as in the case of earrings.

Having described general forms of earrings in accordance with the invention, it is to be pointed out that further detailed consideration and attention have to be paid in practically designing the earrings. FIGS. 14 to 18 show different embodiments of the invention in which the bases for holding the magnetic disks are made of non-magnetic alloys.

Figure 14:
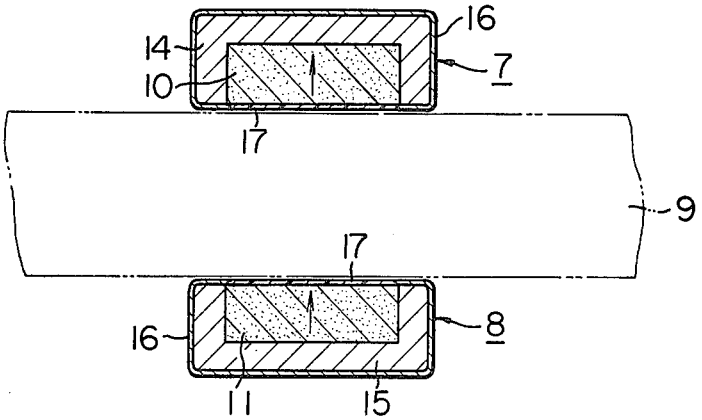

FIG. 14 shows a cross-section of an earring in which numerals 7, 8, and 9 denote an ornament piece, attracting piece and an earlobe, while magnetic disks are designated at numerals 10 and 11. Numerals 14 and 15 denote bases, while a decorative plated layer which may be a gold-plated layer is designated at numeral 16.

A buffering coating 17 may be made of a vinyl film.

The ornament piece 7 and the attracting piece 8 are made of a copper alloy such as brass and have bases 14 and 15 having central recesses in which embedded are the magnetic disks 10 and 11. The direction of magnetization of the magnetic disks is shown by an arrow. The surfaces of the bases 14, 15 are plated with, for example, gold, so as to have the decorative plated layer 16. The surfaces which are to be brought into direct contact with the earlobe are covered with the buffering coating 17 made of a soft material such as vinyl film.

Instead of the magnetic disk either the ornament piece 7 or the attracting piece may be made of a soft magnetic material such as iron having an anti-rust plated layer. However, preferably, both of these pieces have the respective one of the magnetic disks 10, 11.

Figure 15:
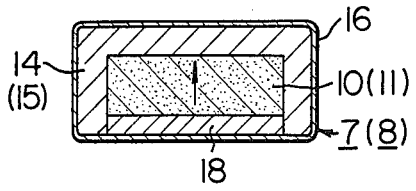

FIG. 15 shows in cross-section still another form of the earring in accordance with the invention. This earring has a similar construction to that of FIG. 14, excepting that the magnetic disks are deeply embedded in the bases 14, 15, so that the entire surface of the ornament piece 7 and/or the attracting piece 8 may be plated, and that a back cover 18 such as of copper alloy is provided and wholly plated with gold.

Figure 16:
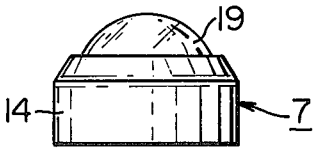

FIG. 16 shows an embodiment of the earring in accordance with the invention in which a gem such as natural gem, artificial gem, cut glass or the like is attached to the base.

Figure 17:
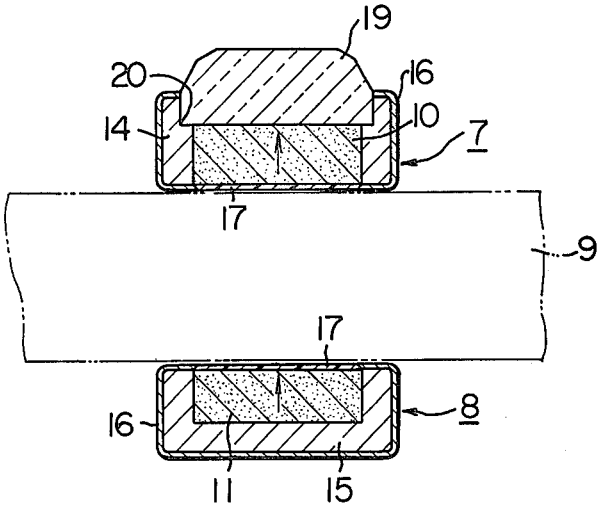

FIG. 17 shows in cross-section a different embodiment of the invention. For facilitating the mounting of the gem 19 as shown in FIG. 16, a groove 20 is formed at the upper portion of the base 14. The gem 19 is received by the groove 20 and fixed by means of an adhesive. Decorative plated layer 16 of, for example, gold is provided on the surfaces of the bases 14, 15 and so on.

Figure 18:
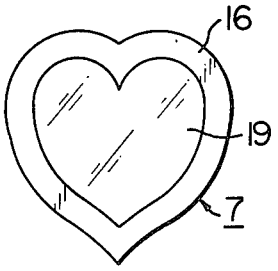

FIG. 18 shows a further embodiment of the invention in which the bases are formed of a copper alloy and can be shaped by diecasting to have any desired form. For instance, the ornament piece 7 can have any desired shape such as of a heart, drop and so forth, other than circular or disk-shape.

These various shapes can be obtained most simply and effectively by means of diecasting.

FIG. 18 shows an example in which the surface of a heart-shaped base is plated with gold to form the decorative gold-plated layer 16, and a heart-shaped gem is attached. As will be seen from FIG. 17, it is not always necessary to make the magnetic piece have specific shape other than circular, even when the base is specifically shaped. In other words, the circular shape of the magnetic disks is effective commonly for various shapes of the base.

The gold color of the surface of the earring is not exclusive, although this color is most attractive to people. The material of the base has been described to be a copper alloy, because this material is most preferred as the base for the gold-plating, and because this material conveniently functions to prevent the magnetic disks from being damaged.

What is claimed is:

1. An ornament comprising an ornament piece, an attracting piece and means for mutually attracting said pieces, the means for mutually attracting including a rare earth-cobalt permanent magnet secured to one of said pieces and being of a size and construction adapting said pieces to cooperate to produce, when said pieces are confronted by each other across an interposed non-magnetic body of a thickness of 2.5 mm or larger, a magnetic attracting force between said pieces ranging between 30 and 100 grams per square centimeter of area of contact of said pieces with said body and greater than 30 grams per gram weight of said ornament.

2. The ornament as claimed in claim 1, wherein said ornament is an earring while said interposed non-magnetic body is an earlobe and wherein said ornament piece is provided on the front side of said earlobe while said attracting piece is located on the back side of said earlobe.

3. The ornament as claimed in claim 1, wherein said means for mutually attracting includes two rare earth-cobalt magnets formed in plate-like shapes, each of said magnets being secured to an individual one of the pieces and being magnetized in the thicknesswise direction from one surface to the other thereof.

4. The ornament as claimed in claim 3, wherein said magnets secured to said ornament piece and said attracting piece have different areas by which they confront said interposed non-magnetic body.

5. The ornament as claimed in claim 4, wherein said magnet secured to said ornament piece has a larger confronting area than that of said magnet secured to said attracting piece.

6. The ornament as claimed in claim 4, wherein said magnet secured to said ornament piece has a smaller confronting area than that of said magnet secured to said attracting piece.

7. The ornament as claimed in claim 4, wherein said magnet having the smaller confronting area has a thickness larger than that of the magnet having the larger confronting area.

8. The ornament as claimed in claim 1, wherein said magnet has a plurality of magnetic poles on the surface confronting said body.

9. The ornament as claimed in claim 4, wherein at least one of said magnets has a plurality of magnetic poles on the surface confronting said body.

10. The ornament as claimed in claim 1, wherein said magnet is provided on its side opposite to said body with a yoke of a soft-magnetic material.

11. The ornament as claimed in claim 4, wherein at least one of said magnets is provided on its side opposite to said body with a yoke of a soft-magnetic material.

12. The ornament as claimed in claim 8, wherein said magnet is provided on its side opposite to said body with a yoke of a soft-magnetic material.

13. The ornament as claimed in claim 1, wherein said magnet is embedded in a base made of a metallic material.

14. The ornament as claimed in claim 13, wherein at least the surface of said base is made of a copper alloy.

15. The ornament as claimed in claim 13, wherein said base has a decorative plating layer over at least a part of its surface.

16. The ornament as claimed in claim 13, wherein said base is formed by a diecasting.

17. The ornament as claimed in claim 13, wherein said magnet is provided at its surface contacting said body with a buffering coating.

18. The ornament as claimed in claim 1, wherein said means for attracting includes a rare earth-cobalt permanent magnet secured to one of the pieces and a soft-magnetic material secured to the other.

19. The ornament as claimed in claim 18, wherein the permanent magnet is formed in a plate-like shape.

20. The ornament as claimed in claim 19, wherein the permanent magnet has two poles each of which is on a surface of the plate-like shape.

21. The ornament as claimed in claim 20, wherein the piece having the permanent magnet has a yoke made of a soft-magnetic material on one pole of the magnet.

22. The ornament as claimed in claim 19, wherein the permanent magnet has a plurality of magnetic poles on a surface of the plate-like shape.

* * * * *